United States Patent [19]

Perret

[11] Patent Number: 4,773,246

[45] Date of Patent: Sep. 27, 1988

[54] PROCESS FOR ADJUSTING THE PROFILE OF ROLLS MOVABLE IN A ROLLING MILL AND IMPROVED ROLLING MILL FOR CARRYING OUT THE PROCESS

[75] Inventor: Jean Perret, Montbrison, France

[73] Assignee: Clecim, Courbevoie, France

[21] Appl. No.: 14,410

[22] Filed: Feb. 13, 1987

[30] Foreign Application Priority Data

Feb. 14, 1986 [FR] France ..... 86 02044

[51] Int. Cl.[4] ..... B21B 31/18; B21B 31/32; B21B 37/00

[52] U.S. Cl. ..... 72/247; 72/8; 72/20; 72/21; 72/243; 72/245

[58] Field of Search ..... 72/247, 21, 20, 245, 72/243, 8

[56] References Cited

U.S. PATENT DOCUMENTS

| | | | |
|---|---|---|---|
| 3,334,506 | 8/1967 | Hicks | 72/243 |
| 3,398,564 | 8/1968 | Barten | 72/243 |
| 3,902,345 | 9/1975 | Shida | 72/21 X |
| 3,943,742 | 3/1976 | Katiwara et al. | 72/247 |
| 4,499,748 | 2/1985 | Nihei et al. | 72/247 X |

FOREIGN PATENT DOCUMENTS

| | | |
|---|---|---|
| 0067040 | 12/1982 | European Pat. Off. . |
| 0084927 | 8/1983 | European Pat. Off. . |
| 0018210 | 1/1985 | Japan . |

*Primary Examiner*—Robert L. Spruill
*Assistant Examiner*—Steven B. Katz
*Attorney, Agent, or Firm*—Pollock, Vande Sande & Priddy

[57] ABSTRACT

A rolling mill with axially movable rolls, comprising a supporting frame (4), at least two working rolls (1, 1') and at least two back-up rolls (2, 2'), at least one of the working rolls (1) being associated with means (42) for moving the roll (1) along its axis (10) and, for each chock (3), with two symmetrical sets of at least two bending jacks (6, 66). The offset of the roll (1) in relation to a centering position is measured continuously, and the pressure exerted by each bending jack (6) is adjusted at each moment as a function of the offset measured and of the position at the same moment of the particular jack (6) in relation to the mid-plane (P5) of a bearing (12), such that the resultant of the bending forces exerted by all the jacks (6, 66) remains directed at each moment in the mid-plane (P5) of the bearing (12), the bending jacks bearing on the chocks by sliding faces.

9 Claims, 5 Drawing Sheets

PROCESS FOR ADJUSTING THE PROFILE OF ROLLS MOVABLE IN A ROLLING MILL AND IMPROVED ROLLING MILL FOR CARRYING OUT THE PROCESS

FIELD OF THE INVENTION

The invention relates to a process for adjusting the profile of rolls movable axially in a rolling mill, and to a rolling mill for carrying out the process.

BACKGROUND OF THE INVENTION

In general terms, a rolling mill comprises, within a supporting frame, at least two working rolls which bear along a rolling plane on at least two back-up rolls. Tne rolls are carried at their two ends, by means of bearings, in chocks mounted so as to be movable parallel to the rolling plane in apertures made in the sides of the supporting frame. So-called "four-high" mills, comprising two working rolls each bearing on a back-up roll, and so-called "six-high" mills, in which intermediate rolls are interposed between the back-up rolls and the working rolls, are conventionally used. In both cases, the axes of the rolls are arranged in a generally vertical rolling plane, but it is also possible for each working roll to bear on a larger number of intermediate and/or back-up rolls placed symmetrically on either side of the rolling plane.

In order to control the thickness of the rolled product and, in particular, obtain an equal thickness transversely to the rolling direction, the working rolls and, if appropriate, the intermediate rolls are bent or curved by means of bending devices acting on the chocks of the particular roll. A distinction is made between positive bending corresponding to an increase in the distance between the chocks on either side of the plane of the product and negative bending corresponding to a decrease in the distance between the chocks.

In general, for each chock the bending device consists of two sets of jacks arranged symmetrically on either side of the rolling plane and each acting in the desired direction on a bearing part integral with the chock. Normally, each bearing part of the chock bears on two jacks set apart from one another in the axial direction symmetrically on either side of the mid-plane of the bearings of the chock, so that the bending force is effectively distributed over the bearings.

The frame of the rolling mill is symmetrical relative to a mid-plane perpendicular to the rolling plane and corresponding to that of the rolled product. Normally, the rolls are therefore centered on this plane, relative to which the chocks are arranged symmetrically.

However, it may be advantageous to ensure longitudinal movement of these rolls, whether in the opposite direction or not, in order to achieve various aims, such as uniformity of wear of a rolls or the check of the planeness or profile of the rolled product. It will be appreciated that the axial movement of the rolls presents difficulties when these are subjected to a bending force. Consequently, the two operations are usually carried out separately, the bending force being canceled when an axial movement is executed. However, it is expedient, during rolling, to combine the effects of the axial movement and bending of the rolls.

Moreover, the torque is usually exerted on a single pair of rolls, for example the working rolls, and is transmitted to the corresponding back-up rolls by means of friction. But it is necessary for all the rolls to continue to be driven at the same peripheral speed.

Consequently, even if the axial movement is executed when the rolling force is absent, it is useful to maintain a certain amount of bending in order to preserve sufficient friction between the rolls.

So that the axial movement of the rolls can be executed without ceasing to exert bending force, it has been proposed to associate with each movable roll and with its chocks a frame conisisting of two beams which are mounted so as to slide axially on the frame of the rolling mill and on which bear the bending devices which thus move at the same time as the rolls, their chocks and the frame. However, this arrangement renders the production of the rolling mill more complicated and makes it necessary to place four relatively bulky beams inside the mill frame and near the working rolls, i.e., in a space which it is expedient to keep free.

SUMMARY OF THE INVENTION

An object of the invention is a new device which, without subscantially modifying the construct1on of the rolling mill, makes it possible to execute at the same time the bending and the axial movement of the working rolls or of the intermediate rolls.

According to the invention, the bending force is exerted by means of fixed jacks which bear, on one side, on a support integral with the frame and, on the other, on a sliding face provided on the corresponding chock parallel to the axial direction of movement. In order to carry out the bending of the movable roll, the offset of the latter in relation to the centering position of the roll relative to the mid-plane of the product is measured at each moment, and for each chock the individual pressure exerted by each jack is adjusted continuously as a function of the offset measured and of the position at the same moment of the particular jack in relation to the mid-plane of the bearing, in such a way that, in each chock, the resultant of the bending forces exerted by all the jacks remains directed at each moment in the mid-plane of the bearing.

The invention also embraces an improved rolling mill for carrying out the process, in which the bending jacks of each chock are mounted on a fixed support integral with the frame, and bear, in the direction of the bending force, on a sliding face provided on the chock parallel to the axial direction of movement. Furthermore, the rolling mill is associated with a balancing device comprising a means of measuring the offset of the particular roll in relation to its centering position relative to the mid-plane of the product, and means for the individual adjustment at each moment of the pressure exerted by each bending jack, as a function of the offset measured and of the position at the same moment of the particular jack in relation to the midplane of the bearing, in such a way that the resultant of the bending forces exerted by all the jacks remains directed at each moment in the mid-plane of the bearing.

In a preferred embodiment, the two chocks of each movable roll each being associaied with two symmetrical sets of bending jacks arranged on either side of the rolling plane, the jacks placed, respectively, in each of the sets, in the same relative positions in relation to the mid-plane of their respective bearings, are connected in parallel to one and the same branch of a common pressurized-fluid supply circuit having as many branches as there are jacks in each set, each branch being equipped with a means for the individual adjustment of the fluid pressure, with equal flow rates being maintained in all the branches.

Advantageously, the means for the individual adjustment of the pressures in the jacks comprise, in each branch of the supply circuit, a servo valve controlled by a means for calculating the corrections to be made to the pressures as a function of the offset measured and displayed on the calculation means and the respective positions of the jacks fed via the particular branch.

According to an especially advantageous feature of the invention, each chock can be associated with positive and negative bending means, each comprising two opposite sets of at least two jacks acting respectively to increase the distance between the rolls for positive bending and to decrease the distance between these for negative bending. These sets of jacks are arranged in hydraulic blocks placed on either side of the rolling plane in the apertures of the frame. Each block consists of a solid supporting piece comprising a projecting central part bordered by two longitudinal recesses, into which engage the bearing lugs of the chock, these each being equipped with a continuous sliding face parallel to the axis, and the said sliding faces are located opposite lateral faces of the central part, in which two by two opposing bores are made along an axis parallel to the rolling plane and each forming a jack body, in which slides a piston integral with a rod extends into the corresponding recess in order to bear on the sliding surface of the chock.

Preferably, the rods of the jacks are capped with bearing plates on the sliding surfaces associated with columns for absorbing the axial forces, which are mounted so as to slide parallel to the rod of the jack in guide bores made in the hydraulic block, elastic washers advantageously being interposed between the bearing plates and the sliding surfaces.

BRIEF DESCRIPTION OF THE DRAWINGS

The invention will be better understood with the aid of the following description of a particular embodiment given by way of example and illustrated in the accompanying drawings.

DESCRIPTION OF PREFERRED EMBODIMENT

Figure 1:
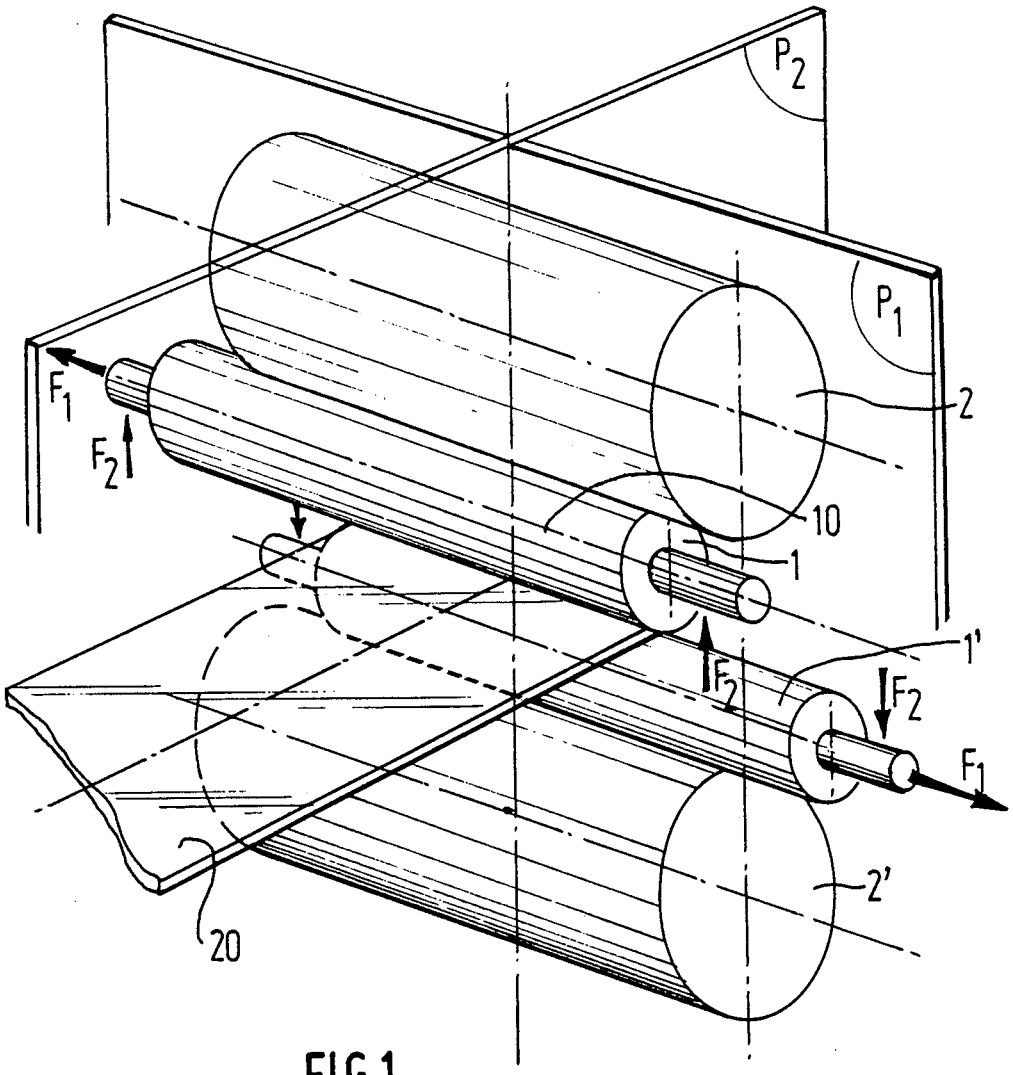
FIG. 1 shows diagramatically, in perspective, the mode of operation of a four-high mill with movable rolls.

FIG. 1 shows diagramatically a four-high rolling mill comprising two working rolls 1 and 1' and two back-up rolls 2 and 2'. The axes of the rolls are parallel and arranged along a rolling plane P1 passing through the contact generatrices.

The rolled product 20 passes between the working rolls 1 and 1' and its mid-plane P2 corresponding to the plane of symmetry of the mill frame as a whole and particularly of the back-up rolls 2 and 2'. Normally, the rolls are all aligned and centered on the plane P2. However, for the reasons mentioned above, the working rolls 1 and 1' can be moved axially relative to the centering position, in such a way that their respective transverse planes of symmetry are offset on one side or the other in relation to the mid-plane P2. For this purpose, an axial movement force F1 is exerted on the working rolls 1 and 1'.

On the other hand, according to another known arrangement, bending forces F2 are exerted on the ends of the shafts of the working rolls 1 and 1' by means of their chocks, in order to effect bending of the corresponding roll.

By means of the arrangements according to the invention, the working rolls 1 and 1' can be subjected at the same time to an axial movement force F1 and to the bending forces F2.

Figure 2:
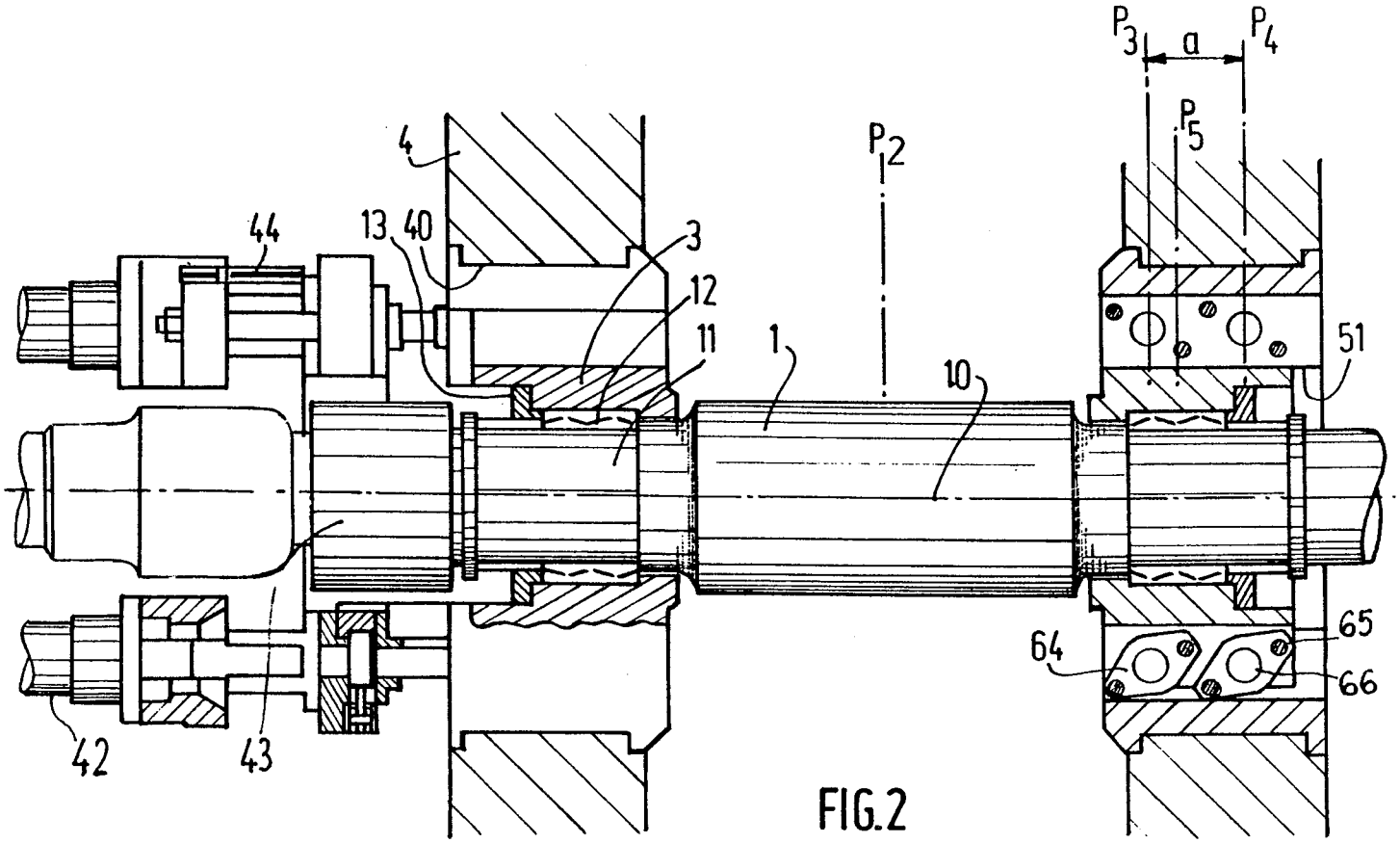
FIG. 2 is a plan view, partially in axial section, of a roll and its means of movement.

FIG. 2 shows as a whole a working roll, its chocks and the axial movement device.

The working roll 1 is equipped at its ends with journals 11 centered by means of bearings 12 inside chocks 3 which form a bearing body and which are mounted so as to slide parallel to the rolling plane P1 in apertures 40 made in the two uprights 4 of the mill frame.

Figure 3:
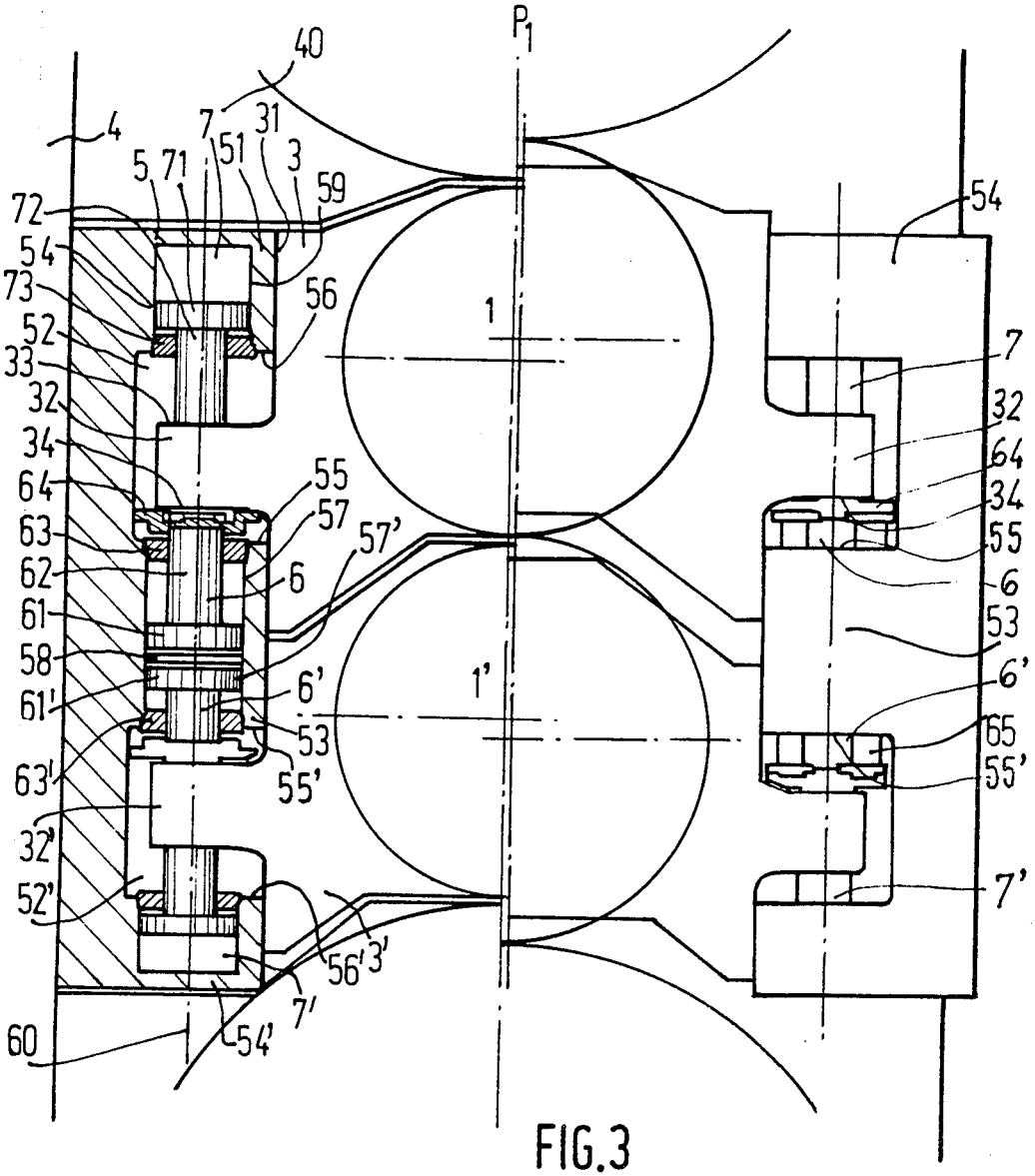
FIG. 3 is a view of the chocks of the two working rolls and the bending devices in a section through a plane perpendicular to the rolling plane.

As shown in FIG. 3, each chock 3 of the working roll is equipped, for this purpose, with sliding faces 31 which are parallel to the rolling plane P1 and which can slide along corresponding faces 51 provided towards the interior on supporting pieces 5 fastened in the apertures 40 of the mill frame 4. Each supporting piece 5 is common to the two working rolls 1 and 1' and has longitudinal recesses 52 arranged on either side of a projecting central part 53 and limited towards the outside by lateral parts 54, the guide faces 51 being provided at the end of the central part 53 and of the lateral parts 54. The chocks 3 and 3' of the working rolls 1 and 1' are equipped with bearing parts or lugs 32, 32' which engage the corresponding recesses 52, 52' of the supporting piece 5 and are equipped with continuous plane faces 33, 34 arranged opposite the lateral faces 55, 56 of the central part 53 and of the lateral part 54 respectively.

In the example illustrated, the rolling mill is equipped with positive and negative bending means. The positive bending means consist, for each chock, of two pairs of jacks 6 arranged on either side of the mid-plane P1 in the central parts 53 of the supporting pieces 5, the bending jacks of the two working rólls 1 and 1' being opposite one another two by two, forming two rows centered in planes P3, P4 parallel to the mid-plane P2 and set axially apart from one another by a distance a (FIG. 2). FIG. 3 is a section through the axial plane of a row, for example P3.

Figure 4:
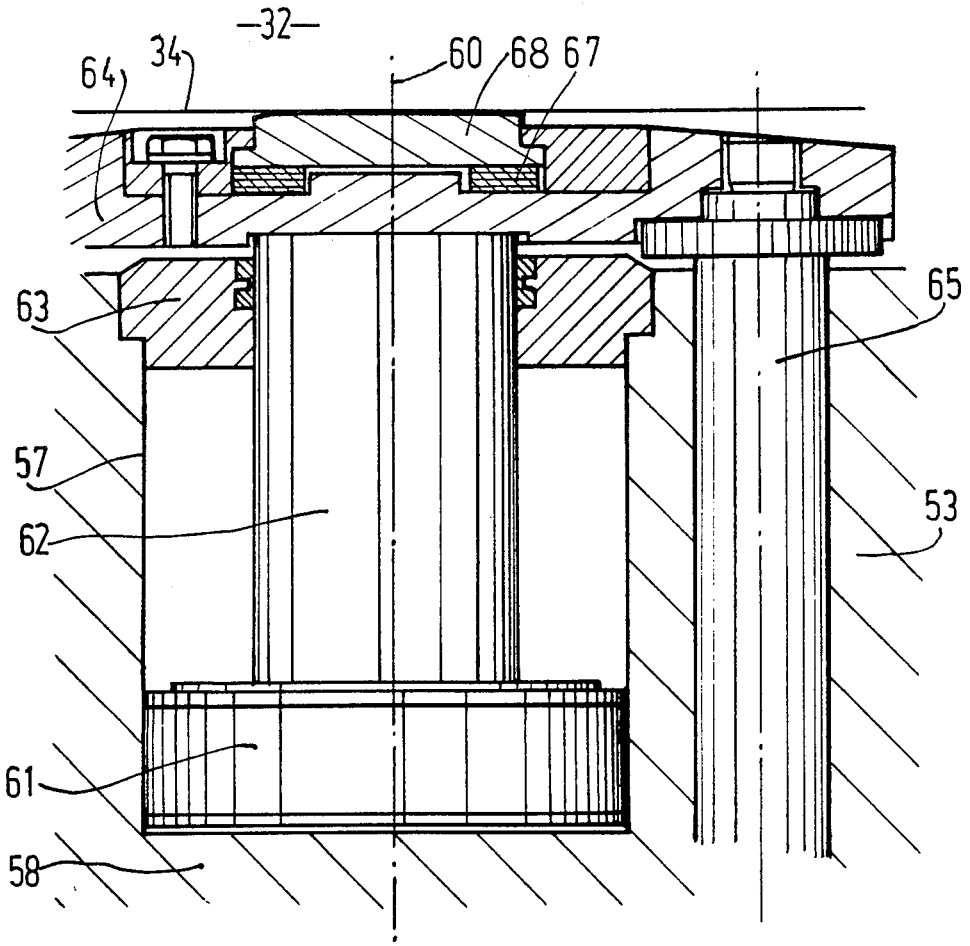
FIG. 4 is a detailed view of a bending jack.

For each row of jacks, therefore, there are in the central part 53 of the supporting piece 5 two opposing bores 57, 57' which are centered on the axis 60 of the positive bending jacks 6 and 6' and which open out respectively onto the side faces 55, 55' of the central part 53. The two bores 57, 57' are separated by a central partition 58 and form the bodies of the two jacks 6 and 6', inside which slide pistons 61, 61' extended by rods 62, 62' which pass through partitions 63, 63' sealing off the bores 57, 57'. The two jack chambers formed in this way inside each bore 57, 57' can be fed via a hydraulic circuit (not shown), the supporting piece 5 thus constituting an actual hydraulic block. The rods 62 of the two jacks 6 and 6' bear on the faces 34 of the bearings 32 of the chocks 3 by means of plates 64 likewise shown in FIGS. 2 and 4. As can be seen in FIG. 2, each plate 64 has a diamond shape with two tips, to which are fastened the ends of guide columns 65 mounted so as to slide parallel to the axis 60 of the jack in bores made in the central piece 53. Moreover, the plate 64 bears on the face 34 of the bearing part 32 of the chock 3 by means of a cap 66 and an elastic washer 67.

Advantageously, each chock 3, 3' is likewise associated with negative bending jacks 7, 7' arranged in bores 59, 59' made in the lateral parts 54, 54' of the supporting piece (5) and opening out onto the side faces 56, 56'. Each bore 59 forms the body of the jack 7, inside which slides a piston 71 integral with a rod 72 which passes in a sealed manner through a partition 73 closing the bore 59, within which the piston 71 thus limits two jack chambers connected to a hydraulic circuit provided in the supporting piece 5.

Normally, it is not necessary to carry out negative bending during the axial movements.

The rod 72 of each jack 7 therefore bears directly on the face 33 of the bearing 32 located opposite it.

As can be seen in FIG. 2, each chock 3 can slide parallel to the axis 10 of the roll along the guide faces 51 of the supporting piece 5. On the other hand, the two chocks 3 of each roll 1 are connected to the latter fixedly in the axial direction by means of caps 13 for closing the cages of bearings 12, the latter being capable of absorbing axial forces, for example conical bearings. In this way, the two chocks 3 of each roll 1 follow the axial movements of the roll. Several devices for the axial movement of the rolls are already known, and there is therefore no need to describe them in detail. It is possible, for example, to use a jack bearing on a rocker which makes it possible to exert the axial movement force on both sides of the chock 3.

However, if the moved roll 1 is a driving roll, it is also possible, as shown in the drawing, to use two movement jacks 42 fed in synchronism, arranged symmetrically on either side of the means 43 of driving the roll 1 in rotation, and bearing on the bearings 32 of the corresponding chock 3, each jack 42 being centered in a plane parallel to the rolling plane and passing through the axes of the bending jacks 6 and 7, and to feed it in synchronism.

Figure 5:
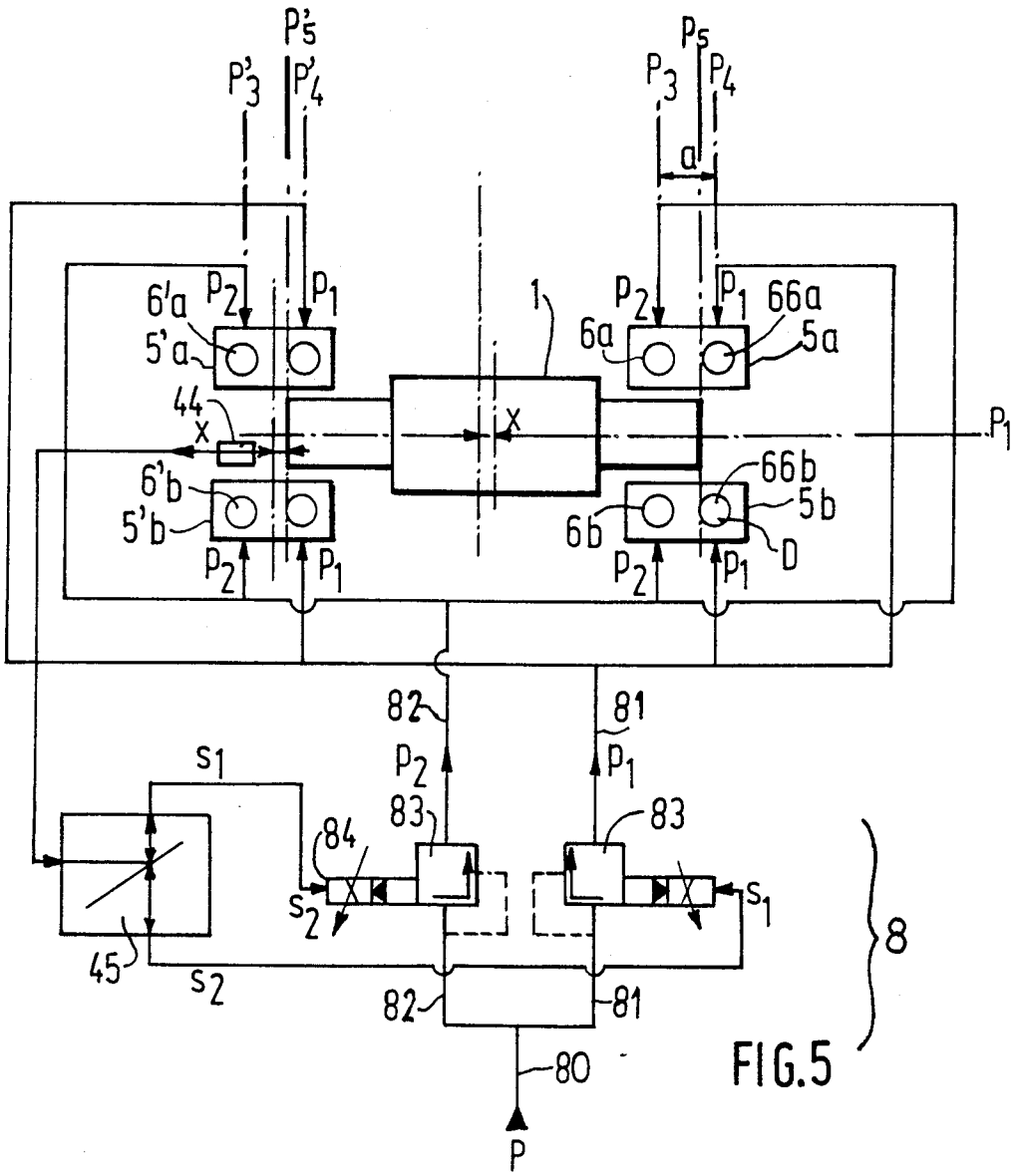
FIG. 5 gives a hydraulic diagram of the balancing device.

According to one of the essential features of the invention, the offset of the moved roll 1 relative to the mid-plane P1 is measured by means of a movement sensor 44 comprising two parts which slide relative to one another and are fastened, for example, to the two parts of one of the jacks 42, and which supply an analog signal proportional to the offset of the working roll in relation to the centering position in the mid-plane of the product and with a sign corresponding to the direction of the offset. This signal is used for balancing the pressures in the bending jacks by means of a device 8 shown diagramatically in FIG. 5.

This figure illustrates, by way of example, a movable roll 1 and its two bending devices, each comprising two sets of jacks placed in hydraulic blocks 5*a*, 5*b*, 5'*a*, 5'b, each set comprising two jacks 6*a*, 66*a*; 66*b*; (6'*a*, 66'*a*; 6'*b*, 66'*b*).

As mentioned above, the four jacks are centered in two transverse planes P3 and P4 set apart from one another by a distance a.

The hydraulic blocks 5*a*, 5*b* and 5'*a*, 5'*b* of the two chocks are connected, by means of a single supply circuit 80, to a source of pressurized fluid (not shown). The circuit 80 is divided into two branches 81 and 82. The branch 81 feeds in parallel the jacks 6*a*, 6*b*, 6'*a*, 6'*b* of the two rows P3 and P'3, while the branch 82 feeds in parallel the jacks 66*a*, 66*b*, 66'*a*, 66'*b* of the two rows P4 and P'4.

The hydraulic circuit is intended to feed all the jacks at one and the same flow rate, making it possible to execute equal movements at the same speed.

Each branch 81, 82 of the supply circuit 80 is equipped with a pressure regulator 83 which, as a function of the signals received at its input 84, regulates the pressure in the corresponding circuit, at the same time maintaining a constant flow rate in the latter.

The sensor 44 detecting the axial movements of the roll 1 supplies an analog signal proportional to the movement, this signal being applied to a computing unit 45. On the basis of the signals received, the latter prepares the nominal pressure values S1 and S2 applied to the inputs 84 of the sensors 83 of the two branches 81 and 82 as a function of a pre-programmed law, making it possible to ensure such a pressure distribution that the resultant of the thrust forces exerted by the bending jacks in the planes P3 and P4 always remains directed at each moment in the midplane of the corresponding bearings. Thus, as shown in FIG. 2, even in the centering position of the rolls 1 in the mid-plane P1 of the product, the two rows of jacks P3 and P4 are not necessarily symmetrical in relation to the mid-plane P5 of the bearing, and this makes it possible to arrange the jacks in the most suitable way inside the hydraulic blocks 5. the plane of symmetry of which does not necessarily coincids with that of the bearing.

During the movement. the bearing plates 64 of the bending jacks slide along the faces S1 of the chocks, the axial forces be absorbed by the columns 65. so that they are not transmitted to the rods 62 of the jacks 6.

By means of this arrangement. It is therefore possible to execute the bending of the working roll at the same time as its axial movement. without substantially modifying the overall size of the bending devices acting on the chocks which remain fixed within the frame and which are simply associted with hydraulic blocks connected to a pressure balancing circuit.

Although jacks have been described in the example illustrated, it would also be possible, by means of the pressure balancing achieved according to the invention, to use a larger number of jacks, making it possible to distribute the pressures more effectively.

Likewise, the various members used for balancing the pressures could be replaced by means performing the same functions, and these means could be hydraulic, electrical or even mechanical (cam, lever arm, etc.) . In general terms, any technology for measuring movements, calculating corrections and balancing pressures can be used to obtain the desired result.

Finally, it will be noted that, as shown in FIG. 3, the fixed bending devices according to the invention can be matched to different roll diamaters and/or to a variation in diameter attributable to wear in the limit of the stroke of the jacks.

I claim:

1. A rolling mill with axially movable rolls, comprising (a) a supporting frame;

(b) at least two working rolls, bearing along a rolling plane on at least two back-up rolls;

(c) chocks for supporting ends of said working rolls by means of bearings, each chock being slidably mounted in an aperture of said supporting frame, parallel to said rolling plane, each bearing having a median plane;

means for moving at least one of said working rolls along its axis on either side of a centering position of the working rolls on a midplane of a rolled product passing between said working rolls;

(e) supporting pieces fastened in apertures of said frame;

(f) bending means for applying a bending force on said working rolls and comprising, for each chock of said working roll, two symmetrical sets of at least two bending jacks set apart from one another in an axial direction and arranged on either side of said rolling plane;

(g) each set of bending jacks being mounted in an corresponding one of said supporting pieces, the bending jacks of the two working rolls being opposite one another, two by two, and forming two rows centered in a plane parallel to said mid-plane and set axially apart from one another, said bending jacks of each set bearing, in the direciton of bending force, on a sliding face provided on the corresponding chock parallel to an axial direction of movement; and (h) a balancing device comprising means for measuring the offset of said working roll in relation to the centering position and means for individual adjustment, at each movement, of the pressure exerted by each bending jack, as a function of the offset measured and of the position, at the same moment, of the particular jack in relation to said median plane of said bearing.

2. A rolling mill as claimed in claim 1, wherein the jacks located respectively in each of the sets of bending jacks, in the same relative positions in relation to said median plane of their respective bearings, are connected in parallel to one and the same branch of a common pressurized-fluid supply circuit comprising as many branches a there are jacks in each set, each branch being equipped with means for individual adjustment of fluid pressure, with equal flow rates being maintained in all the branches.

3. A rolling mill as claimed in claim 2, wherein the means for the individual adjustment of tne pressures in the jacks comprise a servo valve in each branch of the supply circuit, the said servo valves being controlled by a means of calculating, on the basis of a programed law, corrections to be made to the pressures as a function of the offset measured and displayed by the calculation means and the respective positions of the jacks fed via the particular branch, in order to ensure a correct distribution of the pressure force.

4. A rolling mill as claimed in anyone of claims 1, 2 and 3, wherein each chock is associated with means of positive bending and of negative bending, each comprising two opposing sets of at least two jacks acting respectively to increase the distance between the rolls for positive bending and to decrease the distance between them for negative bending.

5. A rolling mill as claimed in claim 1 wherein the sets of jacks are arranged in hydraulic blocks placed on either side of the rolling plane in the apertures of the frame, in which the chocks slide, wherein each block is composed of a solid supporting piece comprising a projecting central part bordered by two longitudinal recesses, into which engage bearing parts of the chock, each equipped with a continuous sliding face parallel to the axis, the said faces being located opposite side faces of the central part in which there are bores opposite one another two by two along an axis parallel to the rolling plane and each forming a jack body, in which slides a piston, integral with a rod extending into the corresponding recess in order to bear on the sliding face of the chock.

6. A rolling mill as claimed in claim 5, wherein the rods (62) of the jacks are capped with bearing plates on the sliding faces, associated with columns for absorbing the axial forces, which are mounted so as to slide parallel to the rod of the jack in guide bores made in the hydraulic block.

7. A rolling mill as claimed in claim 6, wherein elastic washers are interposed between the bearing plates and the sliding surfaces.

8. A rolling mill as claimed in claim 5, wherein each bearing part of a chock is equipped, on the opposite side to the central part, with a second sliding face located opposite a projecting lateral part of the supporting piece, in which there are bores of an axis parallel to the rolling plane and forming the bodies of negative bending jacks, in which slide pistons integral with rods bearing on the said second sliding face in the direction bringing the chocks together.

9. In a process for adjusting the profile of rolls movable axially in rolling mill comprising, inside a supporting frame, at least one working rolls which bear along a rolling plane on at least two back-up rolls and the ends of which are carried, by means of bearings, in chocks mounted so as to be movable in the supporting frame, parallel to the rolling plane, said process including the steps of carrying out simultaneously an axial movement of at least one working roll in relation to a centering position, in which the two working rolls are symmetrical relative to the mid-plane of the rolled product, and bending of the moved roll, by exerting a bending force on its ends, said bending force being exerted on each chock by means of two sets of at least two bending jacks set axially apart from one another, said bending jacks of each set being mounted on each side of said rolling plane, on a supporting piece integral with a frame and bearing on a sliding face provided on the corresponding chock parallel to the axial direction of movement, the improvement comprising, for effecting the bending of the working roll during its axial movement, the steps of (a) measuring at each moment the offset of the movable roll in relation to the centering position; and (b) adjusting continuously for each chock the individual pressure exerted by each jack of each set as a function of the offset measured and of the position at the same moment of the corresponding jack in relation to a midplane of the bearing, such that, in each chock, the resultant of the bending forces exerted by all the jacks remains directed at each moment in the mid-plane of the bearing.

* * * * *